United States Patent [19]

Yamotogi

[11] Patent Number: 4,741,366

[45] Date of Patent: May 3, 1988

[54] HAND-WEAVING DEVICE

[75] Inventor: Kuniharu Yamotogi, Osaka, Japan

[73] Assignee: Yokota Co., Ltd., Osaka, Japan

[21] Appl. No.: 43,638

[22] Filed: Apr. 28, 1987

[30] Foreign Application Priority Data

Dec. 18, 1986 [JP] Japan ..... 61-195789[U]

[51] Int. Cl.[4] ..... D03D 29/00

[52] U.S. Cl. ..... 139/34; 28/152

[58] Field of Search ..... 139/29, 33, 34; 28/151, 28/152

[56] References Cited

U.S. PATENT DOCUMENTS 2,190,813 2/1940 Walker ..... 139/34
3,209,336 9/1965 Erikson et al. ..... 28/152
3,800,372 4/1974 Daoust ..... 28/152
4,046,172 9/1977 Russell ..... 139/33

FOREIGN PATENT DOCUMENTS 89290 6/1985 Japan .

*Primary Examiner*—Henry S. Jaudon
*Attorney, Agent, or Firm*—Morgan & Finnegan

[57] ABSTRACT

A hand-weaving device which contains a body having a large number of small holes arranged regularly, for weaving pins are inserted into the holes to stand upright, a longitudinal thread is turned around to the pins for warping, and a tranverse thread is woven between the warpings by use of a needle, a shuttle board and the like.

7 Claims, 3 Drawing Sheets

FIG. 1
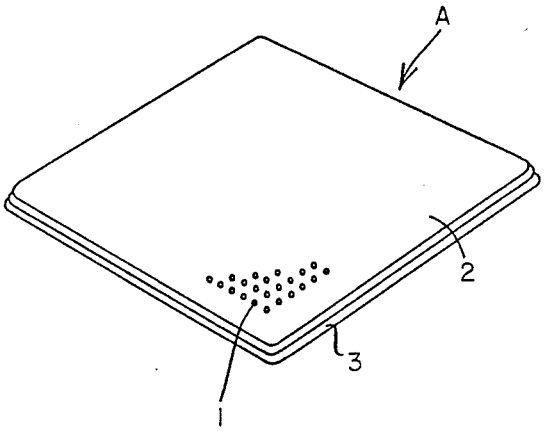
FIG.3(I)
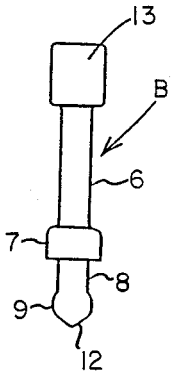
FIG.3(II)
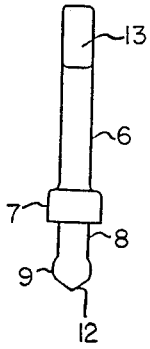
FIG.2
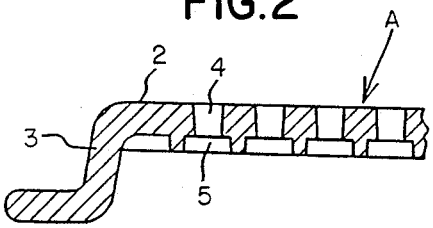
FIG.4(I)
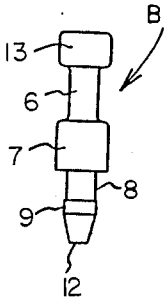
FIG.4(II)
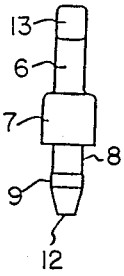
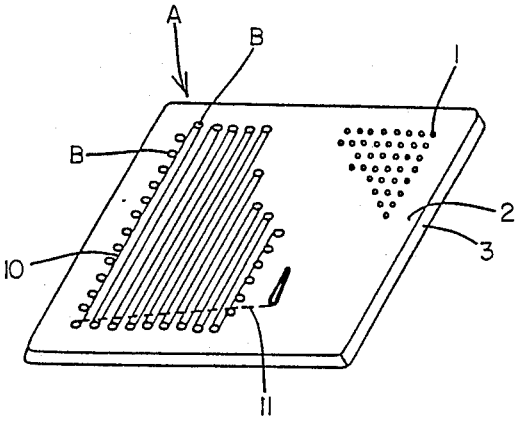
FIG. 5

FIG.6
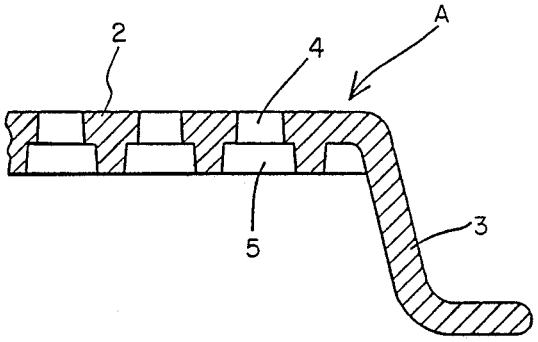
FIG.7(I)
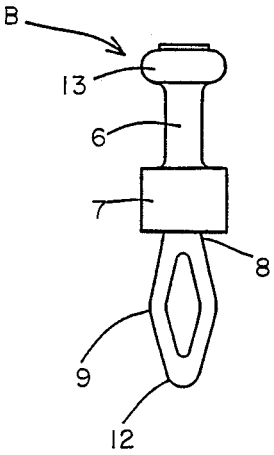
FIG.7(II)
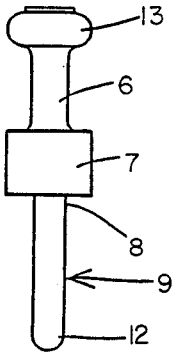
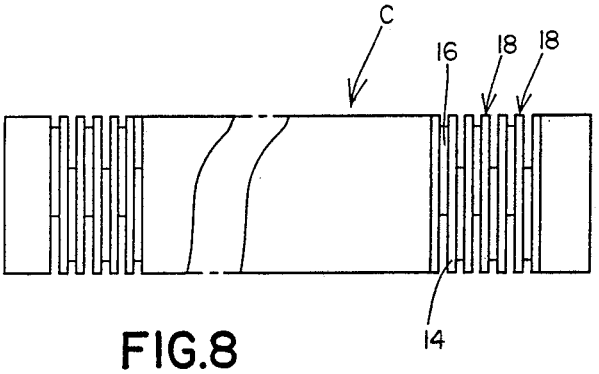
FIG.8
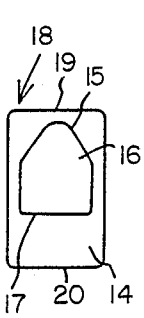
FIG.9(I)
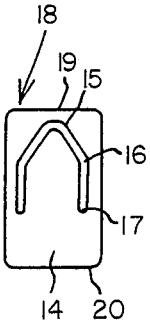
FIG.9(II)

FIG.10(I)
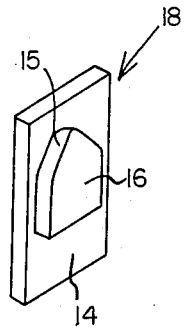
FIG.10(II)
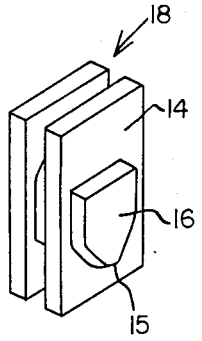
FIG.10(III)
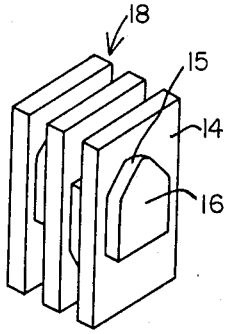
FIG.11
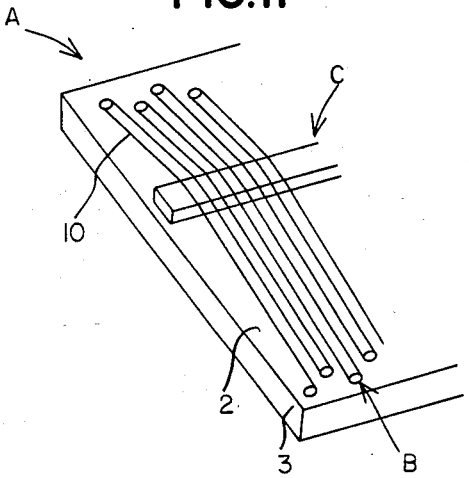
FIG.12
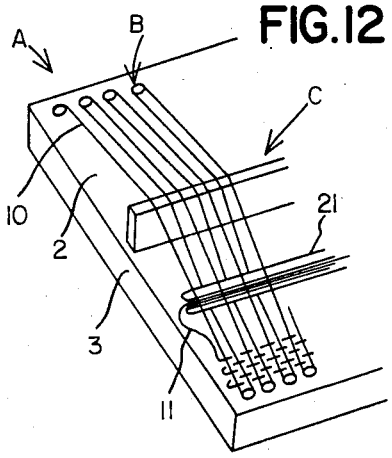
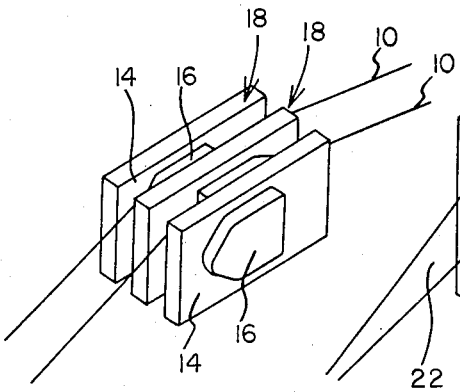
FIG. 13
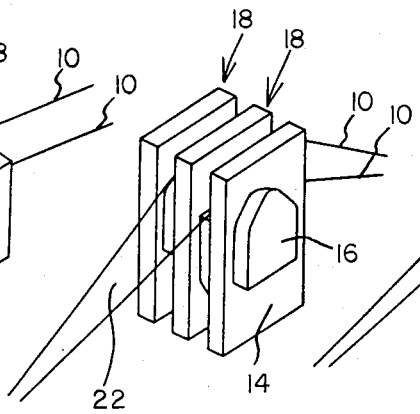
FIG.14
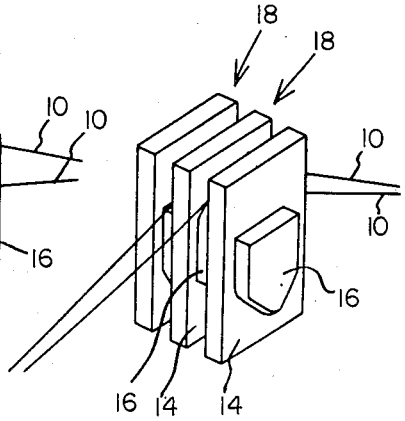
FIG.15

HAND-WEAVING DEVICE

BACKGROUND OF THE INVENTION

The present invention relates to a hand-weaving device which includes a small-diameter multihole type plastic board.

In conventional hand-weaving for fabrics, a thread is turned around pins which stand upright on a board, i.e., for warping, and then transverse threads (weft) are passed over and under the longitudinal thread (warp) by use of a needle, a shuttle board or the like, as known well. As a conventional hand-weaving device for such use, a wooden frame work having pins pierced into the peripheral portion at equal intervals, a corrugated board having pins pierced therein, and so forth are known. However, these handweaving devices are limited in the shape and size of formed fabrics. Also, these devices are deficient in the operational performance. According to one of improved hand-weaving devices disclosed in Japanese Laid Open Utility Model Publication No. 89290 of 1985, pins are pierced into a thick board such as a corrugated board and the like, and convered with a çap at the upper end, respectively. Weaving by use of the device is inefficient, since it takes much time to position and pierce the pins into a required pattern. Also, the device is unprofitable, because the thick board once used are so damaged as to be re-used.

It is therefore a main object of the invention to provide a hand-weaving device by which such hand-weaving can be effected with ease and high efficiency.

SUMMARY OF THE INVENTION

A hand-weaving device of the present invention includes a plastic board as a body which comprises a plastic plate having small holes therein, each of the small holes being arranged at an interval of 3 to 10 mm into a lattice form, and pins applied to be inserted into the small holes. The respecitve small holes are composed of an upper opening portion having a relatively small diameter, and a lower opening portion. The upper and lower opening portions are concentrically continuous with each other. The diameter of the upper opening portion is smaller at a lower position of the upper opening portion, so that the upper opening portion is slightly thinner toward the lower end thereof. The pin contains a rod-form portion, a fringe positioned below the rod-form portion and having a diameter larger than that of the upper end of the upper opening portion, a narrow portion positioned below the fringe and having a diameter of nearly the same size as that of the lower end of the upper opening portion, and a lowermost portion containing an expansion portion and being thinner toward the tip. The maximum diameter of the expansion portion is smaller than that of the upper end of the upper opening portion in the small hole, is larger than that of the upper opening portion at the lower end thereof, and is smaller than that of the lower opening portion in the small hole. The length of the narrow portion is substantially equal to, or slightly lower than, that of the upper opening portion in the small hole.

THE DETAILED DESCRIPTION OF THE INVENTION

According to a hand-weaving device of the invention which contains a body having a large number of small holes arranged regularly, for weaving pins are inserted into the holes to stand upright, a longitudinal thread is turned around to the pins for warping, and a transverse thread is woven between the warpings by use of a needle, a shuttle board and the like.

According to the invention, the rod-form portion of the pin around which a longitudinal thread is turned, is positioned a distance to the plastic board due to engagement of the fringe with the plastic board. For weaving, the pins can be desirably arranged in conformation to a pattern paper placed on the surface of the plastic board. Also, changes of the used longitudinal or transverse thread can be easily effected. Preferably, a plastic board in the invention is a transparent board. For weaving, a pattern paper is placed under the plastic board. The operator can arrange the pins and weave a fabric of a desired shape and size, seeing the pattern paper through the transparent plastic board.

A small hole in the invention has a two step-structure which is composed of an upper opening portion having a relatively small diameter and a lower opening portion having a diameter slightly larger than that of the upper opening portion. Furthermore, the diameter of the upper opening portion is slightly smaller at a lower position thereof. The pin comprises a thin tip, an expansion portion having a predetermined diameter, a narrow portion, and a fringe, in the order of the upward direction from the thin tip so that the pin can be easily inserted into a small hole in the plastic board downwardly and fixed securely. As the tip of a pin is thin, and the portion positioned above the tip has a smaller diameter than that of the upper end of the small hole, the insertion of the pin can be easily effected. Though the diameter of the expansion portion is a larger than that of the lower end of the upper opening portion in a small hole, the elasticity of the plastic board enables the expansion portion to be passed into the lower opening portion with ease by more or less impressing the pin downwardly. Once the expansion portion is passed into the lower opeing portion, the pin resists to the depression because of the fringe positioned above the narrow portion having nearly the same length as that of the upper opening portion in the small hole. The fringe and the expansion portion clips the plastic board therebetween, so that the pin is securely fixed to the small hole.

Accordingly, in weaving, even when a longitudinal thread is turned around pins and applied by a large tention force, the pins are not distorted or displaced, and very uniform warping can be achieved.

Preferred materials of a plastic board in the invention includes ABS, polystyrene, polyethylene, polypropylene, acrylic resins and the like. The leg portion disposed on the plastic board is not limited in particular shape, size and the material. However, from the economical viewpoint, it is preferred that the leg portion is moulded integrally with the plastic board.

The height of the leg portion is not particularly limited so long as the leg forms such a space under the plastic board that a pattern paper can be placed under the plastic board and be handled freely. Preferably, the leg portion has such a height that the plastic board becomes about 7 to 30 mm in height.

It is prferred that the thickness of the plastic board is within the range of 2 to 6 mm, and the length of the upper opening portion in the small hole is within the range of 1.5 to 3 mm. Preferably, the difference between the diameters of the upper and lower ends of the upper opening portion is within the range of 0.15 to 0.5 mm.

Generally, the pin used in the invention may be made of rigid materials such as metal, wood and plastics. It is preferred to be made of plastics such as polyethylene, polyamide and the like.

BRIEF DESCRIPTION OF THE DRAWINGS

The invention will be further described with reference to the accompanying drawings.

FIG. 1 is a perspective view of a preferred embodiment of the body of a hand-weaving device in the invention.

FIG. 2 is a partially enlarged sectional view of the embodiment shown in FIG. 1.

FIGS. 3, 4 and 7 are front and side views of different embodiments of a pin in the invension.

FIG. 5 is a perspective view which illustrates use of a hand-weaving device of the invention.

FIG. 6 is a partially enlarged view of another embodiment of a hand-weaving device of the invention.

FIG. 8 is a front view of a preferred embodiment of a heald in the invention.

FIG. 9 is a front view of one of preferred units which constitute a heald as shown in FIG. 8.

FIG. 10 is a perspective view of a preferred heald which illustrates the construction of the heald.

FIG. 11 is a perspective view of the heald in FIG. 8 which illustrates use of the heald at the beginning of the setting.

FIG. 12 is an elementarily enlarged perspective view of the use of the heald shown in FIG. 11.

FIG. 13 is a perspective view of the heald in use.

FIG. 14 is an elementarily enlarged perspective view of the heald in use as shown in FIG. 13.

FIG. 15 is an elementarily enlarged perspective view of the heald turned to 180° along the plastic board.

In one embodiment as shown in FIG. 1, the body (A) is integrally formed of an transparent acrylic resin, and has a size of 50 cm×50 cm by 10 mm high. The leg portion (3) has a skirt-form. The thicknesses of the leg (3) and the upper opening portion (4) in the plastic board (2) are 2.5 mm, respectively, and the thickness of the lower opening portion (5) in the plastic board (2) is 1.5 mm.

Small holes (1) have a circular section. The number of small holes (1) is 8464 and they are arranged into a lattice-form (92×92). The distance between the centers of adjacent small holes (1) is 5 mm. The upper opening portion (4) of the small hole (1) has a diameter of 2.75 mm at the upper end, and a diameter of 2.5 mm at the lower end, so that the upper opening portion (4) is slightly thinner toward the lower end. The lower opening portion (5) has a diameter of 3.5 mm at the upper end and a diameter of 3.75 mm at the lower end (see FIG. 2).

As a pin (B), one made of polyamide is preferably used. As shown in FIG. 3 (I) and (II), the pin B comprises a holding portion (13) of a plain-sheet form (5 mm long by 4.5 mm wide by 2.5 mm thick), a rod-form portion (6) of 2.5 mm diameter by 10 mm long, a fringe (7) of 4.5 mm diameter, a narrow portion (8) of 2.3 mm diameter by 2.5 mm long, and a lowermost portion of 3 mm long. The lowermost portion contains an expansion portion (9) and a tip (12) which is thinner downwardly. The expansion portion (9) takes such a form as if a ball of 2.7 mm diameter were attached to the narrow portion (8).

For insertion of a pin (B) into a small hole (1) in the plastic board (2), first, the tip (12) of the pin (B) is placed into the upper opening portion (4) of the small hole (1), and by lightly pushing the pin (B) downward, the narrow portion (8) is fitted to the upper opening portion (4), so that the pin (B) can be securely located at a predetermined position. For weaving, pins (B) are arranged in conformation to a pattern paper, and a longitudinal thread (10) is turned around pins (B) for warping. Then, a transverse thread (11) is woven over and under the longitudinal thread (10) to obtain a desired fabric.

Since the maximum diameter of the expansion portion (9) of a pin (B) is of nearly the same size as that of the small hole (1) at the lower end, and further the plastic board (2) has a more or less elasticity, the pin (B) can be extracted out of the small hole (1) easily for removal.

A pin (B) may take such a form as shown in FIG. 4. In this embodiment, the pin (B) contains a holding portion (13) of 3.5 mm long by 4.5 mm wide by 2.5 mm thick, a round-rod-form portion (8) of 2.5 mm diameter by 5 mm long, a fringe (7) of 4.5 mm diameter by 5 mm long, a narrow portion (8) of 2.5 mm diameter by 2.7 mm long, and an expansion portion (9) of 2.6 mm diameter by 1.5 mm long, in succession. The expansion portion (9) is thinner at a lower position thereof, and a tip portion (12) positioned 2.5 mm below the expansion portion (9) has the diameter of 1.5 mm.

FIG. 6 illustrates one of preferred hand-weaving devices of the inventin which are suitably applied for weaving using a thick thread.

In this embodiment, the size of the body (A) is 50 cm×50 cm by 18 mm high. The leg portion (3) has a skirt-form as well as that of the hand-weaving device shown in FIG. 1. The thicknesses of the leg portion (3) and the upper opening portion (4) in the plastic board (2) are 2.5 mm, respectively. The thickness of the lower opening portion (5) in the plastic board (2) is 2.5 mm.

Small holes (1) in the plastic board (2) takes a circular section. 3249 small holes (1) are arranged in a lattice form (57×57), in which the distance between the centers of adjacent small holes (1) is 8 mm. The upper opening portion (4) of the small hole (1) is thinner downwardly. The upper opening portion (4) has a diameter of 3.5 mm at the upper end and a diameter of 3.8 mm at the lower end. The lower opening portion (5) has a diameter of 5.5 mm at the upper end and a diameter of 5.8 mm at the lower end.

As a pin (B), one as shown in FIG. 3 or 4 may be used, but the pin (B) as shown in FIG. 7 is preferably used. The pin (B) shown in FIG. 7 comprises a holding portion (13) of 17 mm diameter by 2.5 mm long at the upper end of the pin B, a round-rod portion (6) of 3 mm diameter by 7 mm long positioned below the holding portion (13), a fringe (7) of 7 mm diameter, and a lowermost portion of 2.7 mm thick by 12.5 mm long.

The lowermost portion comprises a narrow portion (8) positioned at the upper end of the lowermost portion, and an expansion portion (8) positioned below the narrow portion (8) and extending in the side direction at the middle thereof to have an O-shape. The maximum width of the expansion portion (9) is 5.5 mm.

In weaving, since the expansion portion (9) of the pin (B) has a hollow structure as above-mentioned, the pin (B) can be attached into or removed from the small hole (1) with much ease due to a spring-force generated. Moreover, in the use, the pin B can be fixed to the small hole (1) very securely and stably. Accordingly, handling of the pin B is much facilitated.

In one modified embodiment of hand-weaving devices of the invention as shown in FIGS. 1 and 5, the upper and lower opening portions (4)(5) of a small hole (1) are square in the section, and the sides of the squares are of the same size as the diameters of the upper and lower opening portions (4)(5) as shown in FIGS. 1 and 5, respectively. The hand-weaving device containing an upper and lower opening portions (4)(5) of such configuration can be easily handled for weaving.

In FIG. 8, a preferred heald (C) in the invention is illustrated. The heald (C) comprises multi-units (18) joined together into an elongated rectangular prism. One unit (18) is composed of a rectangular small plate (14) and a substantially U-shaped piece (16) of a predetermined thickness. The U-shaped piece(16) is attached to one side of the small plate (14) in such a manner that the distance between the apex (15) of the U-shaped piece (16) and one shorter side (19) of the small plate (14) is smaller than that between the lower side (17) of the U-shaped piece (16) and the other shorter side (20) of the small plate (14) by more than 5 mm. Multi-units (18) are joined together in such a manner that the small plate (14) of a unit (18) is brought into contact with the U-shaped piece (16) of the next unit (18), and also the apexes (15) of units (18) is alternately reversed in the height. In the embodiment of a heald (C) in FIG. 8, U-shaped piece (16) of 17 mm wide by 22 mm high by 3 mm thick, as shown in FIG. 9 (I) attached to one side of a small plate of 23 mm wide by 38 mm long by 3 mm thick with the apex (15) positioned at the distance of 3 mm to one shorter side (19) of the small plate (14). Then, the units (18), as shown in FIG. 10, are joined together in such a manner that the apexes (15) of the U-shaped pieces (16) are alternately reversed in the height. The total length of the heald (C) is 510 mm.

Referring to hand-weaving by use of such a heald (C), the heald (C) is inserted between the plastic board (2) and a longitudinal thread (10) engaging pins (B) for warping, with the longer side of the small plate (14) brought into contact with the plastic board (14) (see FIGS. 11 and 13). Then, the heald (C) is rotated in such a manner that one shorter side of the small plate (14) is brought into contat with the plastic board (2) (see FIG. 12). Thereby, the longitudinal thread (10) which is in contact with the apex (15) of the U-shaped piece (16) is lifted and the longitudinal thread (10) which is in contact with the lower side (17) of the U-shaped piece (16) is lowered so that a shuttle path (20) is formed (see FIGS. 12 and 14). A shuttle (19) is inserted into the shuttle path (20) to weave a transverse thread (11) therein, and then the heald (C) is turned to 180° along the plastic board (2), so that the alternate higher and lower positions of the longitudinal thread (10) are reversed, respectively (see FIG. 15). A transverse thread (11) is passed through the formed shuttle path (20). Accordingly, withuse of the heald (C), a plain weave can be easily formed by repetition of the above-mentioned procedure.

A U-shaped piece (16) may have a form as shown in FIG. 9 (II). Also, for weaving of relatively thick threads at a relatively wide interval therebetween or formation of a twill weave, the heald may be changed in the above-mentioned order how the units (18) of the heald each containing a U-shape piece (16) attached to a small plate (14) are joined together.

It is preferred that such a heald is formed of plastics. A unit (18) composed of a small plate (14) and a U-shaped piece may be produced by moulding of a plastic, or a heald may be integrally formed of a plastic.

What is claimed is:

1. A hand-weaving device comprising a body (A) including a plastic boad (2) having small holes (1) positioned at intervals of 3 to 10 mm to each other in a lattice-form, and a leg portion (3) formed on the periphery of the plastic board (2), and pins (B) each adapted to be inserted into one of the small holes (1), said small hole (1) being composed of an upper opening portion (4) having a relatively small diameter, and a lower opening portion (5) concentrically continuous with the upper opening portion (4) and having a slightly larger diameter than that of the upper opening portion (4), the diameter of the upper opening portion (4) being slighly smaller at a lower position thereof whereby the upper opening portion (4) becomes thinner toward the lower end, said pin B being composed of a rod-form portion (6), a fringe portion (7) positioned below the rod-form portion (6) and having a diameter larger than that of the upper opening portion (4) at the upper end of the upper opening portion (4), a narrow portion (8) positioned below the fringe portion (7) and having a diameter substantially equal to or slightly smaller than the lower end diameter of the upper opening portion (4), and further a lowermost portion containing an expansion portion (9) positioned below the narrow portion (8), the diameter of said expansion porti on (9) being smaller than that of the upper end of the upper opening portion (4) and larger than that of the lower end of the upper opening portion(4) and smaller than that of the lower opening portion (5), said lowermost portion being thinner from the expansion portion (9) toward the lower end of the lowermost portion, the length of the narrow portion (8) being substantially equal to or slightly longer than that of the upper opening portion (4) of the small hole (1).

2. A hand-weaving device according to claim 1, wherein the body (A) is an integral plastic moulding in which a skirt-form leg portion (3) is formed on the periphery of the plastic board (2).

3. A hand-weaving device according to claim 1, wherein the plastic board (2) is a transparent board.

4. A hand-weaving device according to claim 1, wherein the thickness of the plastic board (2) is within the range of 2 mm to 6 mm, and the height of the body (A) is within the range of 7 mm to 30 mm.

5. A hand-weaving device according to claim 1, wherein the lower opening portion (5) has a slightly larger size toward the lower end of the lower opening portion (5).

6. A hand-weaving device according to claim 1, wherein the small hole (1) is a regular square or round shape in the cross section.

7. A hand-weaving device according to claim 1, wherein a heald (C) comprising multi-units (18) joined together into an elongated rectangular prism is used, said units(18) being composed of a rectangular small plate (14) and a substantially U-shaped piece (16) of a predetermined thickness, and being joined together in such a manner that the small plate (14) of a unit (18) is brought into contact with the U-shaped piece (16) of the next unit (18), and also the apexes (15) of units (18) is alternately reversed in the height.

* * * * *